United States Patent [19]

McRoskey et al.

[11] 3,971,488

[45] July 27, 1976

[54] TAMPERPROOF SCREW CAP

[75] Inventors: John W. McRoskey, Los Angeles; Delbert D. Swartz, Torrance; Michel A. LeBrun, Jr., Sebastapol, all of Calif.

[73] Assignee: Republic Tool & Manufacturing Corporation, Los Angeles, Calif.

[22] Filed: Aug. 12, 1975

[21] Appl. No.: 603,800

[52] U.S. Cl. ..... 215/254; 215/274; 220/319

[51] Int. Cl.[2] ..... B65D 41/32

[58] Field of Search ..... 215/7, 9, 216, 218, 215/254, 274; 220/288, 319; 292/256.6; 222/153

[56] References Cited

UNITED STATES PATENTS

| | | | |
|---|---|---|---|
| 3,850,329 | 11/1974 | Robinson | 215/254 |
| 3,891,110 | 6/1975 | Gach | 215/216 |

*Primary Examiner*—George T. Hall
*Attorney, Agent, or Firm*—Whann & McManigal

[57] ABSTRACT

A tamperproof screw cap for a container which may be locked in place on the container spout, including a lock-band surrounding the cap and having one-way teeth thereon engageable with one-way teeth surrounding the spout which permits the cap to be screwed into place but prevents the cap from being unscrewed until said lock-band is removed.

5 Claims, 6 Drawing Figures

TAMPERPROOF SCREW CAP

BACKGROUND OF THE INVENTION

It is highly desirable to have the cap of a container secured in place from accidental removal, or from being tampered with or removed. This is particularly desirable to protect children from removing caps from containers which may contain harmful substances. It is common practice to enclose the portion of a cap and a portion of a spout or neck of a container or bottle with metal or layer of plastic material which may be removed or torn.

SUMMARY OF THE INVENTION

It is an object of the present invention to provide a locking element or tamperproof element as a separate part which can be installed when the cap is screwed into place and which prevents the cap from being unscrewed. The separate element or lock-band may be made from a plastic material which is relatively strong but which has a tab whereby the lock-band may be torn and removed, thus freeing the cap so that it can be unscrewed.

It is an object of the present invention to provide a lock band or lock member which is assembled with the cap and is non-rotatable with respect thereto and has a shoulder positioned between the cap and the wall from which the spout projects so that when the cap is screwed into place one-way teeth on the shoulder of the lock band engage oppositely directed one-way teeth on the container adjacent to the spout, thus permitting the cap to be screwed into place but preventing the cap from being unscrewed unless the lock band is first removed.

It is a further object of our invention to provide a cap and lock arrangement of the character described in which the locking means is a separate element and is separately removable, and in which at any time it is desired to lock the cap from removal or to render it tamper-proof another lock band may be installed in place. In fact, the cap and lock-band arrangement may be provided with extra bands for use when desired.

It is a further object of our invention to provide an arrangement of the character described in which there is a lock element compressed between the lower end face of the cap and the top surface of the container, said lock means being releasably connected to said cap and being associated with said container so as to be rotatable only in a direction in which the cap is screwed onto the spout of the container.

Other objects and advantages will be made evident during the course of the following detailed description of a preferred form of our invention.

DESCRIPTION OF THE PREFERRED EMBODIMENT

Figure 1:
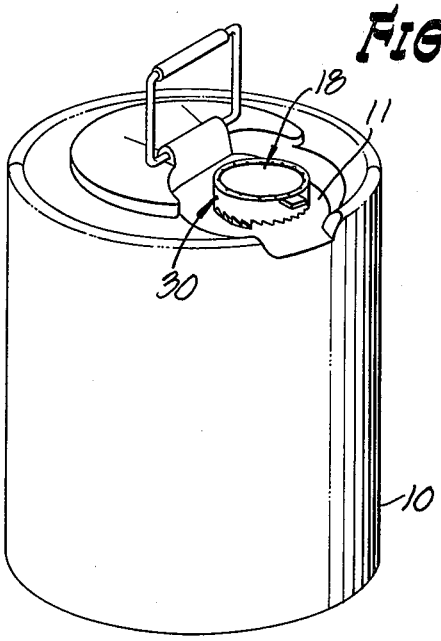
FIG. 1 is a perspective view showing the tamperproof screw cap of our invention applied to a container.
Figure 3:
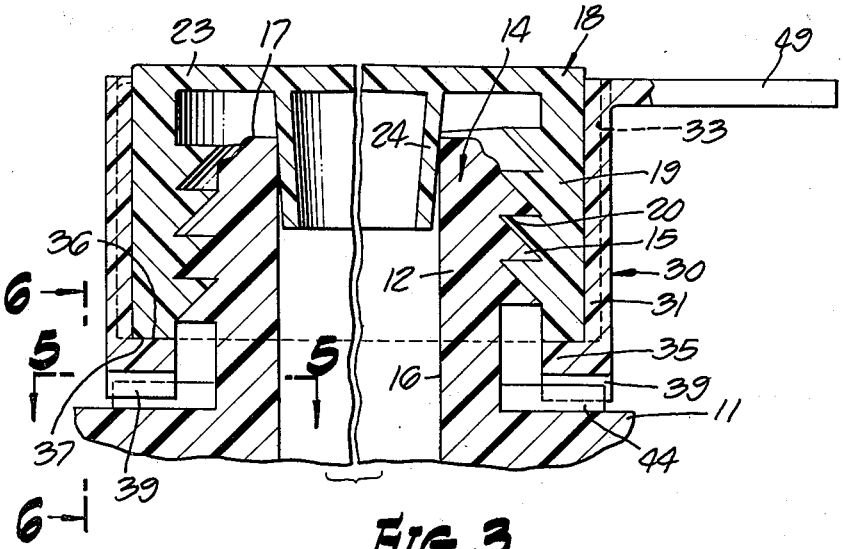
FIG. 3 is a sectional view on the line 3—3 of FIG. 2.

As shown in FIGS. 1 and 3, the numeral 10 represents a container having a top wall 11, having a filling and pouring opening provided by a cylindrical wall 12 which extends from the wall 11 and forms a passageway for filling the container or pouring material from it, this part being referred to as a spout 14. The wall 12 has external threads 15, a cylindrical inner surface 16 and an end surface 17.

Our invention provides a screw cap 18 having a cylindrical wall 19 provided with threads 20 adapted to screw onto the spout 14. An end wall 23 of the cap 18 closes the spout and extending from the end wall 23 toward the spout 14 is a conical wall 24 which fits into the spout and mates with the surface 16 in order to form a seal.

Figure 2:
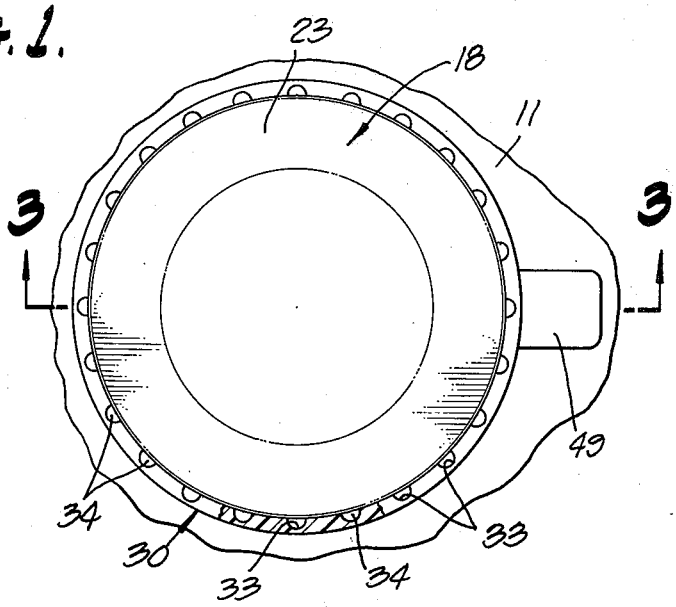
FIG. 2 is a plan view of our invention as applied to the container shown in FIG. 1.

In order to secure the cap 18 in place, making it tamperproof and back-off proof, we provide a lock member or lock band or lock ring 30 which has a cylindrical wall 31 surrounding the wall 19 of the cap 18 and being a slidable fit thereon. To restrain the cap 18 and lock member 30 from relative rotation there is a connecting means which is composed of grooves 33 formed in the inner surface of the cylindrical wall 31 and axial ribs 34 formed on the outer surface of the wall 19 of the cap. The ribs fit in the grooves as shown in FIGS. 2 and 3. The groove 33 may be formed in the wall 19 and the ribs 34 may be formed on the wall 31, if desired.

Figure 6:
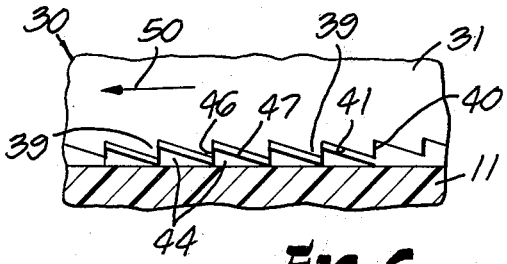
FIG. 6 is a fragmentary view taken on approximately line 6—6 of FIG. 3.

The lock member 30 has an inwardly extending shoulder 35 which projects from the lower portion of the wall 31 and has a surface 36 engaged by the end surface 37 of the cap 18, this shoulder comprising a lock element. The shoulder 35 has locking teeth 39 projecting therefrom toward the wall 11 of the container 10, the teeth 39 are formed by intersecting vertical walls 40 and inclined walls 41 making the teeth saw-shaped. Stationary teeth 44 comprised by intersecting vertical walls 46 and inclined walls 47 (FIG. 6) are formed on the container wall 11 in one or two or more groups. These groups are cylindrically arranged around the area where the spout projects from the wall 11. The stationary teeth 44 and the movable teeth 39 are of substantially the same size and pitch, and faced in complementary directions so that the walls 40 will abut walls 46 while cap 18 is screwed down on spout 14. FIG. 6 shows the manner in which the walls 40 and 46 engage each other.

Figure 4:
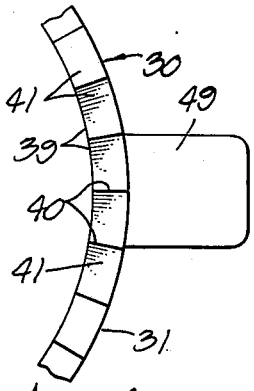
FIG. 4 is a fragmentary bottom plan view of the lock member or lock band of our invention taken on line 4—4 of FIG. 3.
Figure 5:
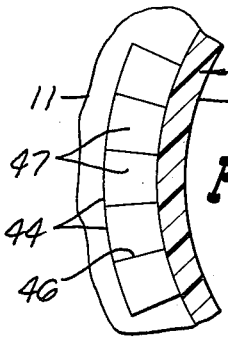
FIG. 5 is a fragmentary view taken on line 5—5 of FIG. 3.

The lock member 30 has a pull tab 49 and the wall 31 may be scored so that when the pull tab 49, FIG. 4, is pulled quite strongly, it will tear away from the main portion of the lock band and sever it.

After the container has been filled, the screw cap is then put into place. The first step is to assemble the cap and lock-band. This may be done by slipping the cap into the lock-band so that the end shoulder 37 engages the shoulder or the end face 36 of the shoulder 35. The ribs 34 fit into the grooves 33 and thus render these two parts nonrotatable relative to each other.

This assembly of the cap and lock-band is then screwed onto the spout 14, the assembly being rotated in the direction of the arrow 50 of FIG. 6. As the cap reaches the position where the sealing flange moves into contact with the cylindrical surface 16, the inclined surfaces 41 and 47 will engage, and as rotation of the cap is continued the teeth will be deformed to permit further rotation of the cap and lock-band. When the parts are thus in place the shoulder or lock element 35 is compressed between the lower surface 36 of the cap and the teeth 44 which comprise a part of the top wall of the container.

When the cap has been screwed tightly in place and a good seal formed at the end of the spout, the teeth will occupy the positions shown in FIG. 6 and because of the vertical or axial shoulders 40 and 46 the locking ring cannot be rotated in the opposite direction to the arrow 50. Also, the cap 18 may not be moved in the opposite or unscrewing direction because of the engagement of the ribs 34 in the grooves 33.

With the parts in the positions described, the cap cannot be unscrewed and the lock member surrounds parts in such a way that there can be no tampering which would enable a removal of the cap without breaking the lock member or band. The parts are made from a relatively strong material, and the lock-ring imparts strength in the areas of pressure and impact. In order to break the band, a substantial pull must be made on the tab 49. When it is desired to remove the cap 18, the tab is engaged very tightly with the fingers or by use of a pair of pliers, and pulled outwardly in order to tear a strip from the band. The band is then removed which frees the cap so that it can be twisted in the reverse direction relative to said shoulder or lock element in order to remove it from the spout.

We claim:

1. A combination spout, cap and locking means for a container comprising:

a. an externally threaded spout;

b. an internally threaded cap screwed onto the spout, said spout having a lower annular surface;

c. a removable lock band surrounding the cap, including a shoulder on said lock band extending inwardly below the lower surface of said cap, said shoulder being engageable by said lower surface and lock means for preventing said cap from being removed from said spout as long as said lock band is in place, said lock means including a plurality of teeth projecting downwardly from said shoulder;

d. stationary teeth positioned on said container adjacent said spout engageable with said teeth on said shoulder permitting said lock-band and cap to rotate in a direction to screw said cap onto said spout, but preventing said lock-band and said cap from moving in an opposite direction, thus preventing the unscrewing of said cap;

e. means cooperating between said cap and said lock-band for preventing relative rotation between the two; and f. means to remove said lock-band from its position on said cap and thereby allowing said cap to be unscrewed from said spout.

2. A combination as defined in claim 1 in which said shoulder, when in position, is clamped between the lower surface of said cap and said teeth on said container.

3. A combination as defined in claim 1 in which said lock-band has a band portion surrounding and engaging the outer annular surface of said cap and in which said means defined in element (*d*) of claim 7 cooperates between said cap and said lock-band.

4. A combination spout, cap and locking means for a container comprising:

a. an externally threaded spout;

b. an internally threaded cap screwed unto the spout, said spout having a lower annular surface;

c. circularly arranged upwardly directed teeth formed on said container around the base of said spout;

d. an annular lock element having lower annularly arranged teeth which project downwardly, said lock element being positioned between said lower surface of said cap and said teeth on said container, the teeth on said lock element engaging said teeth on said container, said teeth being shaped to permit rotation of said lock element in a direction in which said cap is screwed onto said spout, but not in a reverse direction;

e. connecting means connecting said cap and lock element whereby the two are non-rotatable relative to each other; and f. means for releasing said connecting means from said cap to permit said cap to rotate relative to said lock element.

5. A combination as defined in claim 4 in which said connecting means consists of a band portion extending upwardly from said lock element and engaging an annular surface of said cap.

* * * * *